United States Patent [19]

Hisamoto et al.

[11] 4,303,534

[45] Dec. 1, 1981

[54] FOAM FIRE-EXTINGUISHING COMPOSITION AND PREPARATION AND USE THEREOF

[75] Inventors: Iwao Hisamoto, Osaka; Chiaki Maeda; Takasige Esaka, both of Kyoto; Mitsuhiro Nishiwaki, Osaka, all of Japan

[73] Assignee: Daikin Kogyo Co., Ltd., Osaka, Japan

[21] Appl. No.: 84,541

[22] Filed: Oct. 15, 1979

[30] Foreign Application Priority Data

Oct. 14, 1978 [JP] Japan ..... 53-126506

[51] Int. Cl.[3] ..... A62D 1/04

[52] U.S. Cl. ..... 252/3; 169/46; 252/8.05; 252/307

[58] Field of Search ..... 252/3, 8.05; 526/253, 526/254, 246, 248, 250; 169/46

[56] References Cited

U.S. PATENT DOCUMENTS 3,080,347 3/1963 Sandberg et al. ..... 526/254 X 3,475,333 10/1969 Meldrum et al. ..... 252/3

3,562,156 2/1971 Francen ..... 252/3 X 3,919,183 11/1975 Jager et al. ..... 526/248 X 3,944,527 3/1976 McCown ..... 526/246 X 4,171,282 10/1979 Mueller ..... 252/8.05 X

*Primary Examiner*—Richard D. Lovering

*Attorney, Agent, or Firm*—Birch, Stewart, Kolasch and Birch

[57] ABSTRACT

Use of a water-soluble high molecular compound which contains a fluoroalkyl group and a water-solubilizable group, having a molecular weight of not less than 5000 and a fluorine content of not less than 10% by weight and is soluble in water in an amount of at least 0.1% by weight at 25° C. and of which the surface tension is not more than 50 dyn/cm when measured on 0.1 to 5.0% by weight aqueous solution at 25° C., as an additive to a foam fire-extinguishing agent so as to improve and enhance the fire-extinguishing performances of the latter, particularly for the firing of polar organic solvents, is disclosed.

8 Claims, No Drawings

FOAM FIRE-EXTINGUISHING COMPOSITION AND PREPARATION AND USE THEREOF

BACKGROUND OF THE INVENTION

The present invention relates to a foam fire-extinguishing composition. More particularly, it relates to a foam fire-extinguishing composition comprising a water-soluble high molecular compound having a fluoroalkyl group and a water-solubilizable group.

It is known that the addition of a fluorine-containing surfactant to a conventional foam fire-extinguishing agent such as a synthetic surfactant containing no fluorine atom or a hydrolyzed protein-containing foaming agent improves and enhances the fire-extinguishing performances of the latter [cf. Japanese Patent Publication (examined) Nos. 20080/1965, 21078/1972, 26106/1972 and 35239/1977; Japanese Patent Publication (unexamined) No. 29689/1973, etc.]. For instance, a fire-extinguishing composition comprising them can form a thin, aqueous film on the surface of an inflammable liquid to prevent the diffusion of the vapor of the inflammable liquid and inhibit the reignition of the inflammable liquid once extinguished. Further, for instance, the said fire-extinguishing composition can enhance the physical properties such as heat resistance of the foams resulting therefrom. However, such fire-extinguishing composition is not effective in enhancement of the fire-extinguishing performances against the firing due to polar organic solvents such as acetone and ethanol.

As fire-extinguishing agents for polar organic solvents, there are known (1) a composition comprising a hydrolyzed protein and a metal soap dissolved in an amino alcohol, (2) a composition comprising a synthetic surfactant and a metal soap, (3) a composition comprising a synthetic surfactant and a water-soluble high molecular compound such as sodium alginate, etc. However, the composition (1) is required to be used quickly after mixing with water. Further, such composition produces precipitates on storage. The compositions (2) and (3) hardly produce precipitates but, because of using a synthetic surfactant as a main component, liquid resistance is greatly inferior.

SUMMARY OF THE INVENTION

As the result of an extensive study, it has now been found that when a certain specific water-soluble high molecular compound having a fluoroalkyl group is incorporated into a conventional foam fire-extingishing agent, the resulting composition can form stable foams on the surface of a polar organic solvent and prevent the firing due to such polar organic solvent. Advantageously, the foams formed by said composition have high heat resistance and are effective in preventing not only the firing of polar organic solvents but also the firing of petrolic solvents. Further, said composition does not produce any precipitate even after the storage over a long period of time.

According to the present invention, there is provided a foam-extinguishing composition which compriese a foam fire-extinguishing agent and, as an additive, a water-soluble high molecular compound which contains a fluoroalkyl group and a water-solubilizable group, has a molecular weight of not less than 5000 and a fluorine content of not less than 10% by weight and is soluble in water in an amount of at least 0.1% by weight at 25° C. and of which the surface tension is not more than 50 dyn/cm when measured on 0.1 to 5.0% by weight aqueous solution at 25° C.

As the foam fire-extinguishing agent, there may be used any conventional one such as a fluorine-containing surfactant, a synthetic surfactant containing no fluorine atom or a partially hydrolyzed protein-containing foaming agent.

The water-soluble high molecular compounds usable in the present invention has not less than several repeating units and can be differentiated from conventional additives which are non-polymeric compounds having high molecular weights.

The water-soluble high molecular compound is required to have an average molecular weight of not less than 5000, preferably not less than 10000. When the average molecular weight is less than 5000, stable foams are not formed on the surface of a polar organic solvent, and also foams of good heat resistance are not produced on the surface of a petrolic solvent.

The water-soluble high molecular compounds is also required to have a fluroine content of not less than 10% by weight, preferably not less than 15% by weight. When the fluorine content is less than 10% by weight, the technical effect inherent to a fluoralkyl group is not exerted, and therefore stable foams can not be produced on the surface of a water-soluble liquid. The fluoroalkyl group is preferred to be on having 4 to 20 carbon atoms.

The water-soluble high molecular compound is further required to be soluble in water in an amount of not less than 0.1% by weight, preferably not less than 0.5% by weight. In general, a compound having a larger number of fluoroalkyl groups in the molecule exerts a higher fire-extinguishing performance but shows a smaller solubility into water. Therefore, it is usually necessary for the water-soluble high molecular compound to have one or more water-solubilizable groups per each fluoroalkyl group, although the proportion of the fluoroalkyl group content and the water-solubilizable group content may be appropriately decided. Examples of the water-solubilizable group are hydroxyl; 2-oxopyrrolidinyl; carboxyl, phosphate, sulfate and sulfo, in a free or salt foam (e.g. alkali metal, amine or ammonium salts); amino in a free or salt form (e.g. organic acid and inorganic acid salts), etc. A polyoxyethylene group is also an example of the water-solubilizable group, and the use of any compound containing such group with any foam fire-extinguishing agent will be effective in the improvement of the fire-extinguishing performance of the latter but its use with a partially hydrolyzed protein will rather deteriorate the foaming characteristics.

Moreover, the water-soluble high molecular compounds is not required to produce extreme depression of surface tension when dissolved in water. Any one showing a surface tension of not more than 50 dyn/cm, preferably not more than 40 dyn/cm (determined on 0.1 to 5.0% aqueous solution at 25° C.) is satisfactorily used. Any one showing higher than 50 dyn/cm can not form stable foams on the surface of a polar organic solvent.

Specific examples of the water-soluble high molecular compounds usable as the additive are as follows:

(I) Copolymers of fluoroalkyl group-containing unsaturated compounds and unsaturated compounds having a water-solubilizable group or any group convertible thereto such as (a) a compolymer between $Rf—(CH_2)_n—CH{=}CH_2$ and $CH_2{=}CHCOOH$ in a molar ratio of 1:1–10, (b) a copolymer between $Rf—CH_2CH(OH)CH_2OOCCH=CH_2$ and $CH_2=C(CH_3)$ COOH in a molar ratio of 1:1-10, (c) a copolmer between $Rf—CH_2CH_2—OOCC(CH_3)=CH_2$ and

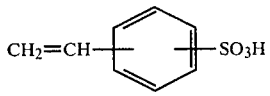

in a molar ratio of 1:1—10, (d) a copolymer between $Rf—SO_2N(C_3H_7)CH_2—CH_2OOCCH=CH_2$ and $CH_2=C(CH_3)COOCH_2CH_2OP(O)(OH)_2$ in a molar ratio of 1:1-10, (e) a copolymer between $Rf—CON(CH_3)CH_2—CH_2OOCC(CH_3)=CH_2$ and $CH_2=C(CH_3)COOCH_2CH_2OP(O)(OH)_2$ in a molar ratio of 1:1-10, (f) a product obtained by hydrolysis of the ester groups in a copolymer between $Rf—CH_2OCH=CH_2$ and $CH_2=CHCOOCH_3$ in a molar ratio 1:5-15, (g) a copolymer between $(Rf)_2CFOCH_2CH=CH_2$ and $CH_2=C(CH_3)COOCH_2CH(OH)CH_2N^{\oplus}(CH_3)_3I^{\ominus}$ in a molar ratio of 1:1-10, (h) a terpolymer of $Rf—CH_2CH(OH)CH_2OOCC(CH_3)=CH_2$, $CH_2=C(CH_3)$ COOH and $CH_2=CHCOOH$ in a molar ratio of 1:1-5:1-5, (i) a terpolymer of $Rf—CH_2CH_2OOCCH=CH_2$, $CH_2=CHCOOH$ and $CH_2=C(CH_3)COOC_{18}H_{37}$ in a molar ratio of 1:1-20:1-5, or products obtained by partial neutralization of the copolymers (a) to (d) with alkali hydroxides or amines or products obtained by partial neutralization of the copolyer (e) or the terpolymer (i) with alkali hydroxides. In the above formulas, Rf is a fluoroalkyl group and n is an integer of 1 to 10.

(II) Fluoroalkyl group-introduced high molecular compounds having a water-solubilizable group or any group convertible thereto such as (j) a product obtained by partial neutralization of a polymer comprising units of

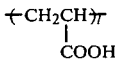

with $RfCH_2CH_2NH_2$ and an alkali hydroxide, (k) a product obtained by partial esterification of a polymer comprising units of

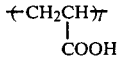

with

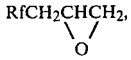

follows by partial neutralization with an alkali hydroxide, (l) a product obtained by partial neutralization of a polymer comprising units of

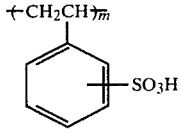

with $RfCONH(CH_2)_3N(CH_3)_2$ and an alkali hydroxide, (m) a product obtained by reacting a copolymer between $CH_2=C(CH_3)$ COOK and

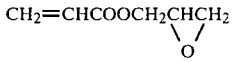

in a molar ratio of 1-10:1 with RfCOOH or (n) a product obtained by partial neutralization of a polymer comprising units of

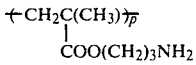

with $RfCH_2CH(OH)CH_2OP(O)(OH)_2$ and acetic acid. In the above formulas, Rf is a fluoroalkyl group, and l, m and p are each positive integer.

(III) Polymers obtained by condensation polymerization, addition polymerization or ring opening polymerization between fluoroalkyl group-containing compounds and water-solubilizable group-containing compounds such as (o) a product obtained by condensation polymerization between

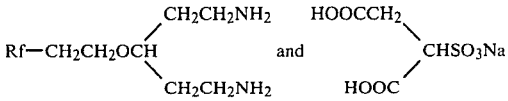

in a molar ratio of 1:1 or (p) a product obtained by addition polymerization between

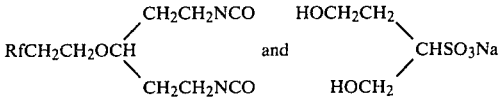

in a molar ratio of 1:1, etc.

Among them, the compounds belonging to (I) can be produced by a conventional polymerization procedure such as solution polymerization, emulsion polymerization or bulk polymerization. Irrespective of the kind of the polymerization procedure as adopted, the compounds are all usable in this invention. The compounds belonging to (II) are obtainable by reacting water-soluble high molecular compounds containing no fluorine atom with fluorine-containing compounds according to a conventional procedure. Some of them may be produced by homopolymerization of compounds having a fluoroalkyl group and a water-solubilizable group.

The amount of the water-soluble high molecular compounds to be added to the foam fire-extinguishing agent may be from 0.2 to 50% by weight, preferably from 0.5 to 30% by weight to the original solution of such foam fire-extinguishing agent. When added amount is smaller than the lower limit, the technical effect is not remarkably exerted. When the added amount is larger than the upper limit, unfavorable influences onto the physical properties of the foams will be produced.

PREFERRED EMBODIMENTS

The present invention will be illustrated in more detail by the following Examples and Comparative Examples wherein part(s) and % are by weight.

EXAMPLES 1 to 3 and COMPARATIVE served, and the stability of the foams was evaluated therefrom. The results are shown in Table 1.

TABLE 1

| Example | Solvent | Water-soluble high molecular compound* | Stability of foam (%) After 10 min. | Stability of foam (%) After 20 min. |
|---|---|---|---|---|
| 1 | Acetone | Product obtained by partial neutralization of a copolymer between $C_9F_{19}CH_2CH(OH)CH_2OOCCH{=}CH_2$ (1 mol) and | 80 | 60 |
| | Methanol | $CH_2{=}C(CH_3)COOH$ (1.6 mol) with NaOH (0.5 mol); MW = 6300; F content = 48.8%; surface tension = 33 dyn/cm | 80 | 70 |
| 2 | Acetone | Product obtained by partial neutralization of a copolymer between $C_6F_{13}CH_2CH_2OOCC(CH_3){=}CH_2$ (1 mol) and | 70 | 60 |
| | Methanol | $CH_2{=}CH$- 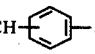 -$SO_3H$ (5.4 mol) with KOH (4 mol); MW = 8800; F content = 15.8%; surface tension = 41 dyn/cm | 80 | 60 |
| 3 | Acetone | Product obtained by partial neutralization of a polymer comprising units of $\leftarrow CH_2CH(COOH)\rightarrow_n$ (n being a positive | 70 | 50 |
| | Methanol | integer) (100 g) with $C_9F_{19}CH_2CH_2NH_2$ (25 g) and NaOH (14 g); MW = more than 50000; F content = 12.9%; surface tension = 45 dyn/cm | 70 | 50 |
| Comparative 1 | Acetone | Product obtained by partial neutralization of a copolymer between $C_9F_{19}CH_2CH(OH)CH_2OOCCH{=}CH_2$ (1 mol) and | 40 | 20 |
| | Methanol | $CH_2{=}C(CH_3)COOH$ (1.3 mol) with NaOH (0.5 mol); MW = 4200; F content = 50.5%; surface tension = 32 dyn/cm | 50 | 30 |
| Comparative 2 | Acetone | Product obtained by partial neutralization of a copolymer between $C_9F_{19}CH_2CH(OH)CH_2OOCCH{=}CH_2$ (1 mol) and | 40 | 10 |
| | Methanol | $CH_2{=}C(CH_3)COOH$ (42 mol) with NaOH (30 mol); MW = 36000; F content = 7.4%; surface tension = 56 dyn/cm | 40 | 20 |
| Comparateve 3 | Acetone | None | disappeared within 5 sec. | — |
| | Methanol | | disappeared within 5 sec. | — |

Notes:
*The molecular weight (MW) was measured by the vapor pressure by the vapor pressure equilibrium method; the fluorine content (F content) was measured by the elementary analysis; the surface tension was measured on 0.5% aqueous solution at 25° C.

EXAMPLES 1 to 3

| Materials | Part(s) |
|---|---|
| Protein foam fire-extinguishing agent, 3% type (comprising hydrolyzed protein and iron salts) | 3.0 |
| Water-soluble high molecular compound as shown in Table 1. | 0.1 |
| Water | 96.9 |

A foam fire-extinguishing composition having the above formulation (100 ml) was charged in a 1000 ml volume polyethylene-made vessel, and a stirrer was set therein. Stirring was continued at 2000 r.p.m. for 2 minutes to make foams. The foams (20 ml) were taken by an injector cut at the top and floated on the surface of methanol (70 ml) or acetone (70 ml) in a 100 ml volume beaker. The amount of the foams remained 10 to 20 minutes after the floating was macroscopically observed, and the stability of the foams was evaluated therefrom. The results are shown in Table 1.

EXAMPLES 4 to 6 and COMPARATIVE EXAMPLES 4 6

| Materials | Part(s) |
|---|---|
| Synthetic surfactant-containing foam fire-extinguishing agent, 3% type (comprising a snythetic surfactant containing no fluorine atom and an alcohol) | 3.0 |
| Water-soluble high molecular as shown in Table 2 | 0.2 |
| Water | 96.8 |

Using a foam fire-extinguishing composition having the above formulation, the evaluation on the stability of the foams was effected as in Examples 1 to 3. The results are shown in Table 2.

TABLE 2

| Example | Solvent | Water-soluble high molecular compound | Stability of foam (%) After 10 min. | Stability of foam (%) After 20 min. |
|---|---|---|---|---|
| 4 | Acetone | Product obtained by partial neutralization of a copolymer between $C_8F_{17}SO_2N(C_3H_7)CH_2CH_2OOCCH{=}CH_2$ (1 mol) and | 70 | 60 |
| | Methanol | $CH_2{=}C(CH_3)COOCH_2CH_2OP(O)(OH)_2$ (3.3 mol) with KOH (2 mol); MW = 19000; F content = 22.9%; surface tension = 30 dyn/cm | 80 | 70 |
| 5 | Acetone | Product obtained by partial neutralization of a polymer comprising units of $\leftarrow CH_2CH(C_6H_4SO_3H)\rightarrow_n$ (n being a positive | 70 | 50 |
| | Methanol | integer) (100 g) with $C_8F_{17}CONH(CH_2)_3N(CH_3)_2$ (59.5 g) and KOH (8 g); MW = more than 50000; F content = 20.8%; surface tension = 38 dyn/cm | 70 | 60 |
| 6 | Acetone | Product obtained by partial neutralization of a polymer | 70 | 50 |

TABLE 2-continued

| Example | Solvent | Water-soluble high molecular compound | Stability of foam (%) After 10 min. | Stability of foam (%) After 20 min. |
|---|---|---|---|---|
| | | comprising units of $\leftarrow CH_2C(CH_3)\rightarrow_n$ (n being a positive $COO(CH_2)_3NH_2$ | | |
| | Methanol | integer) (100 g) with $C_{12}F_{25}CH_2CH(OH)CH_2\phi P(O)(OH)_2$ (54 g) and $CH_3COOH$ (21 g); MW = more than 50000; F content = 18.9%; surface tension = 36 dyn/cm | 70 | 60 |
| Comparative 4 | Acetone | Product obtained by partial neutralization of a polymer comprising units of $\leftarrow CH_2C(CH_3)\rightarrow_n$ (n being a positive $COO(CH_2)_3NH_2$ | 40 | 20 |
| | Methanol | integer) (100 g) with $C_{12}F_{25}CH_2CH(OH)CH_2OP(O)(OH)_2$ (30 g) and $CH_3COOH$ (30 g); MW = 4000; F content = 12%; surface tention = 48 dyn/cm | 50 | 30 |
| Comparative 5 | Acetone | Product obtained by partial neutralization of a polymer comprising units of $-(CH_2C(CH_3)\rightarrow_n$ (n being a positive $COO(CH_2)_3NH_2$ | 30 | 10 |
| | Methanol | integer) (100 g) with $C_{12}F_{25}CH_2CH(OH)CH_2OH(O)(OH)_2$ (13.5 g) and $CH_3COOH$ (20 g); MW = 13000; F content = 6%; surface tension = 54 dyn/cm | 40 | 10 |
| Comparative 6 | Acetone | None | disappeared within 5 sec. | — |
| | Methanol | | disappeard within 5 sec. | — |

EXAMPLE 7

Fire model B (0.45 m×0.45 m×0.3 m (0.2 $m^2$)) was charged with methanol (20 liters) (liquid surface level, 10 cm) and then ignited. Five minutes after ignition, a fire-extinguishing composition was applied thereto through a foaming nozzle (1 liter/min/5 kg/$cm^2$) for a consecutive period of 5 minutes. The time until the foams developed on the surface of burning methanol and prevented firing after the application (prevention time) and the time until firing was completely extinguished after the application (extinguishing time) were measured. Further, torch test was carried out by approaching a torch to the liquid surface 15 minutes after the finishment of the application of the fire-extinguishing composition for the 5 consecutive minutes and observing reignition. The results are shown in Table 3.

TABLE 3

| Fire-extinguishing composition | Prevention time (sec) | Extinguishing time (sec) | Torch test |
|---|---|---|---|
| Example 1 | 50 | 70 | not reignited |
| Example 2 | 55 | 80 | not reignited |
| Example 3 | 65 | 90 | not reignited |
| Comparative Example 1 | 130 | 170 | not reignited |
| Comparative Example 2 | 170 | 220 | not reignited |
| Comparative Example 3 | not prevented | not extinguished | test impossible |

EXAMPLE 8

An iron made vessel (125 mm×250 mm×50 mm) was separated by a metal net into 2 sections, of which a narrow one (25 mm×250 mm×50 mm) was used as a ignition zone and a broad one (100 mm×250 mm×50 mm) was used as a foaming zone. Into the vessel, gasoline (350 ml) was charged, and the foams of a fire-extinguishing composition was admitted into the foaming zone to make a thickness of 40 mm. After 90 seconds, the ignition zone was ignited. The time unitl the foams near the metal net were broken and the firing was started after the ignition (boundary firing time) and the time unitl most of the foams were broken and the firing developed to the whole surface after the ignition (whole surface firing time) were recorded to evaluate the fire resistance of the foams. The results are shown in Table 4.

TABLE 4

| Fire-extinguishing composition | Boundary firing time (sec) | Whole surface firing time (sec) |
|---|---|---|
| Example 4 | 630 | 720 |
| Example 5 | 615 | 700 |
| Example 6 | 585 | 670 |
| Comparative Example 4 | 320 | 400 |
| Comparative Example 5 | 290 | 375 |
| Comparative Example 6 | 160 | 240 |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

1. A foam fire-extinguishing composition which comprises a foam fire-extinguishing agent selected from at least one member of the group consisting of a fluorine-containing surfactant, a synthetic surfactant containing no fluorine atom and a partially hydrolyzed protein-containing foaming agent and, as an additive, from 0.2 to 50% by weight based on said fire-extinguishing agent of a water-soluble high molecular compound having not less than several repeating units which contain a fluoroalkyl group and a water-solubilizable group, a molecular weight of not less than 5000 and a fluorine content of not less than 10% by weight and is soluble in water in an amount of at least 0.1% by weight at 25° C. and of which the surface tension is not more than 50 dyn/cm when measured on 0.1 to 5.0% by weight aqueous solution at 25° C.

2. The composition according to claim 1, wherein the water-solubilizable group is hydroxyl, 2-oxopyrrolidinyl, carboxyl, phosphate, sulfate, sulfo or amino in a free or salt form.

3. The composition according to claim 1, wherein the fluoroalkyl group has 4 to 20 carbon atoms.

4. A method for extinguishing a fire caused by organic polar solvents which comprises the application to said fire of a foam fire-extinguishing composition comprising a foam fire-extinguishing agent selected from at least one member of the group consisting of a fluorine-containing surfactant, a synthetic surfactant containing no fluorine atom and a partially hydrolyzed protein-containing foaming agent and, as an additive, from 0.2 to 50% by weight based on said fire-extinguishing agent of a water-soluble high molecular compound having not less than several repeating units which contain a fluoroalkyl group and a water-solubilizable group, has a molecular weight of not less than 5000 and a fluorine content of not less than 10% by weight and is soluble in water in an amount of at least 0.1% by weight at 25° C. and of which the surface tension is not more than 50 dyn/cm when measured on 0.1 to 5.0% by weight aqueous solution at 25° C.

5. The method of claim 4 wherein said water-soluble high molecular compound additive contains a water-solubilizable group which is a hydroxyl, 2-oxopyrrolidinyl, carboxyl, phosphate, sulfate, sulfo or amino in a free or salt form.

6. The method of claim 4 wherein said water-soluble high molecular compound additive contains a fluoralkyl group having 4 to 20 carbon atoms.

7. In a method for enhancing the fire-extinguishing properties of a conventional foam fire-extinguishing agent the improvement which comprises incorporating into a foam fire-extinguishing agent selected from at least one member of the group consisting of a fluorine-containing surfactant, a synthetic surfactant containing no fluorine atom and a partially hydrolyzed protein-containing foaming agent, an additive having, from 0.2 to 50% by weight based on said fire-extinguishing agent of a water-soluble high molecular compounds having not less than several repeating units which contain a fluoroalkyl group and a water-solublilizable group, a molecular weight of not less than 5000 and a fluorine content of not less than 10% by weight and is soluble in water in an amount of at least 0.1% by weight at 25° C. and of which the surface tension is not more than 50 dyn/cm when measured on 0.1 to 5.0% by weight aqueous solution at 25° C.

8. The method of claim 7 wherein said water-soluble high molecular compound additive contains a water-solubilizable group which is a hydroxyl, 2-oxopyrrolidinyl, carboxyl, phosphate, sulfate, sulfo or amino in a free or salt form, and a fluoroalkyl group having 4 to 20 carbon atoms.

* * * * *